US005820936A

United States Patent [19]

Giannotti

[11] Patent Number: 5,820,936

[45] Date of Patent: Oct. 13, 1998

[54] METHOD FOR THE ORGANOLEPTIC AND SURFACE MODIFICATION OF READY-MADE ITEMS OF CLOTHING AND MACHINE FOR CARRYING OUT THE METHOD

[76] Inventor: Mariano Giannotti, Via Gherbella, 58, 41100 Modena, Italy

[21] Appl. No.: 831,849

[22] Filed: Apr. 1, 1997

[30] Foreign Application Priority Data

Apr. 3, 1996 [IT] Italy ..... MO96A0042

[51] Int. Cl.[6] ..... B05D 3/02; B05D 3/12

[52] U.S. Cl. ..... 427/370; 100/320; 427/381; 427/393.4; 427/412

[58] Field of Search ..... 427/369, 370, 427/389.9, 393.4, 412, 381; 100/320

[56] References Cited

U.S. PATENT DOCUMENTS 4,401,698 8/1983 Garnett et al. ..... 427/370 X 4,749,603 6/1988 Esaki et al. ..... 427/393.4 X 5,645,892 7/1997 Whitley et al. ..... 427/393.4

*Primary Examiner*—Michael Lusignan

*Attorney, Agent, or Firm*—Fenwick & West LLP

[57] ABSTRACT

The method for the organoleptic and surface modification of ready-made items of clothing consists of: a first step for preparing a mix of coloring material, a second step for applying the coloring mix on the item by spraying or spreading, a third step for drying the item, a fourth step for covering with a material which provides waterproofing and/or fixes the applied coloring mix, a fifth step for pressing, with heat and in successive stages, the portions constituting the item of clothing, the pressing being adapted to make the fabric fibers and the coloring mix interact stably with each other.

11 Claims, 1 Drawing Sheet

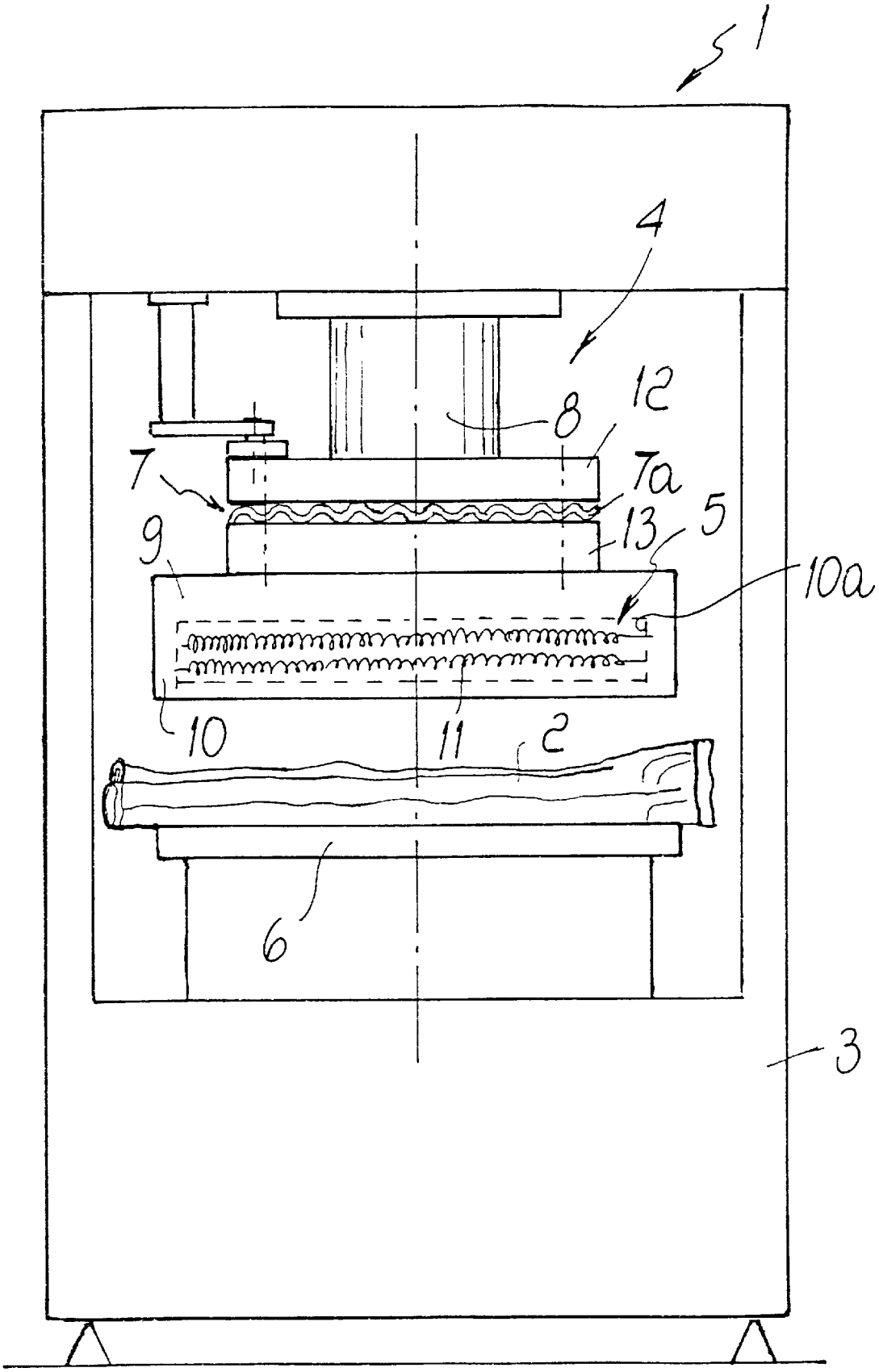
1
4
8
12
7
7a
13
5
9
10a
10
11
2
6
3

METHOD FOR THE ORGANOLEPTIC AND SURFACE MODIFICATION OF READY-MADE ITEMS OF CLOTHING AND MACHINE FOR CARRYING OUT THE METHOD

BACKGROUND OF THE INVENTION

The present invention relates to a method for the organoleptic and surface modification of ready-made items of clothing and to a machine for carrying out the method.

The fashion industry is constantly searching for innovations both from the styling and from the technological points of view.

This second aspect is becoming increasingly important, and large companies have been engaged for a long time in devising for example new fabrics and fibers with which the various items can be produced.

A particular trend of fashion is increasingly orientated towards producing clothing by using plasticized materials having innovative aesthetic effects and which are practical as regards protection from weather effects.

Currently produced items are obtained starting from so-called pieces of fabric, treated before being rolled up into rolls for subsequent use.

In practice, these pieces are prepared by plastic-coating, by passing a ribbon of base fabric and a film, which is superimposed thereon and is made of adapted plastic material, usually polyurethane, between pairs of cylinders (calenders), at least one whereof is heated; by combining the pressing action with the heating action, said cylinder pairs produce the final plasticized fabric to be used for production.

This prior art is susceptible of further improvements, expanding the possibility of producing innovative items of clothing, by plastic-coating them after their manufacture or by treating even already-used and partially-worn items, so as to regenerate them in their condition, adapting them to the dictates of fashion.

SUMMARY OF THE INVENTION

This aim and other objects are achieved by a method for the organoleptic and surface modification of ready-made items of clothing, according to the invention, consisting of a first step for preparing a mix of coloring material, a second step for applying said coloring mix on the item by spraying or spreading, a third step for drying the item, a fourth step for covering with a material which provides waterproofing and/or fixes said applied coloring mix, a fifth step for pressing, with heat and in successive stages, the portions constituting the item of clothing, said pressing being adapted to make the fabric fibers and said coloring mix interact stably with each other.

Advantageously, the machine for carrying out the method is characterized in that it consists of a supporting frame for an upper moving presser unit, provided with thermal means for contact with the items resting on a lower fixed bed, said presser unit being also provided with thermally insulating elements which are adapted to prevent its seizure.

BRIEF DESCRIPTION OF THE DRAWINGS

Further characteristics and advantages of the present invention will become apparent from the following detailed description of a preferred embodiment of a machine for carrying out a method for the organoleptic and surface modification of ready-made items of clothing, illustrated only by way of non-limitative example in the accompanying drawings, wherein the only FIGURE is a schematic front view of the machine for carrying out the method for the organoleptic and surface modification of ready-made items of clothing.

DESCRIPTION OF THE PREFERRED EMBODIMENTS

With particular reference to the above FIGURE, the reference numeral 1 generally designates a machine for carrying out the method for the organoleptic and surface modification of ready-made items of clothing 2, consisting of a frame 3 which supports an upper moving presser unit 4 provided with thermal means 5 for contact with the items 2, said items resting on a fixed lower bed 6.

Said presser unit 4 is provided with thermally insulating means 7 which are adapted to prevent its seizure during travel.

The upper presser unit 4 is constituted by a power hammer 8 having a vertical stroke, actuated by fluid-actuated means, and provided with a thermal head 9 which is adapted to make contact with the items 2.

Said head is substantially composed of a plate 10, inside which respective batteries of electrically energizable resistors 11 are accommodated in corresponding recessed seats 10*a*.

The thermally insulating means 7 are constituted by a gasket 7*a* shaped so as to have a wave-like profile and interposed between two conventional collars 12 and 13 for coupling the head 9 to the power hammer 8.

The execution of the method for the organoleptic and surface modification of ready-made items of clothing is as follows: a layer of coloring mix in pastel or metallic-finish colors is applied to each item which, as mentioned, is already made or even worn by use; said application can be performed either manually or by means of a conventional spray device.

In both cases, the coloring mix can reach all points of the item, including the regions around buttons, zip fasteners, and various seams, as well as folds or turn-ups and any other part which is difficult to access.

In the preferred embodiment according to the present method it has been observed that an excellent result has been achieved by using the products of the CTR company and particularly, for producing the pastel-colored mix, by cold-mixing 100 g of dyes known as SD, 60 g of WACHSTOP, 20 g of TOP L OPACO, 120 g of RPF 4321, and 60 g of POLYTON 760.

Two parts of a rubberizing agent known as CP/6 are also added.

A polyurethane binder is then applied; for glossy finishes, said binder is constituted by E. LACK 2022, whilst for matt finishes it is constituted by E. LACK 2025.

The item is then placed to dry and then a film-forming agent is applied thereon in two layers: a first base layer constituted by 120 g of an aqueous emulsion of copolymerized acrylic esters and a second surface-finish layer constituted by 60 g of an aliphatic polyurethane in an aqueous disperse system.

Finally, a waterproofing agent is applied, said agent being composed of 100 g of polyurethane solution mixed with 4 grams of crosslinking catalyst based on polyaziridine, 4 g of water, and ⅚ g of fatty materials.

Optionally, it is also possible to apply a brightener constituted by 5 g of a plasticized protein binder and a so-called touch modifier, constituted by 20 g of a wax and silicone emulsion.

In order to prepare the mix in metallic-finish colors, the above mixture composing the waterproofing agent is reused with the addition of metal powders or pearlescent agents.

The item 2 thus prepared is first dried and then pressed in steps; in practice, it is rested on the fixed bed 6 of the machine 1, pressed region by region with the plate 10 so as to reach all the parts of the item 2, including the most inaccessible ones, as mentioned.

Said plate 10, by having the resistors 11, upon contact with the item 2 and with the coloring mix applied thereto, triggers and completes a chemical process whereby the molecules of said mix, by cross-linking, stably and durably bind to the fabric fibers, in a wash- and abrasion-resistant manner, at the same time giving the item the intended outward appearance.

The particular configuration of the machine 1, and more specifically the possibility of the plate 10 to descend, pushed by the power hammer 8, onto the item rested on the fixed lower bed 6, allows to easily and very thoroughly complete, region by region, the above-described method on any item of clothing having any shape, practically without any limitation in operation.

It has thus been observed that the described invention achieves the intended aim and objects.

The invention thus conceived is susceptible of numerous modifications and variations, all of which are within the scope of the inventive concept; thus, for example, the various colors and decorations which can be applied may be chosen at will, according to the color effects to be achieved.

All the details may also be replaced with other technically equivalent elements.

In the practical embodiment of the invention, the materials employed, as well as the shapes and the dimensions, may be any according to requirements without thereby abandoning the scope of the protection of the appended claims.

What is claimed is:

1. A method for the organoleptic and surface modification of a ready-made item of clothing comprising the steps of:

preparing a coloring material;

applying said coloring material on an item of clothing;

drying said item of clothing;

covering said item of clothing with a material selected from the group consisting of fixing material, waterproof material and mixture thereof, to provide a covering layer;

pressing said item of clothing under heat to permanently fix fibers of the item of clothing to said covering layer.

2. A method according to clam 1, wherein said coloring material is a mixture of pastel colors.

3. A method according to claim 1, wherein said coloring material is a mixture of metallic-finish colors.

4. A method according to claim 1, wherein said coloring material based on 1000 grams of weight comprises:

260 to 290 g of a cold mixture of organic and inorganic pigments dispersed in casein; 50 to 60 g of a polyurethane binder; 155 to 175 g of an anionic wax foundation emulsion; 5 to 6 g of a rubberizing polyurethane in aqueous solution; 450 to 550 g of two protective film-forming agents.

5. A method according to claim 4, wherein said polyurethane binder is glossy.

6. A method according to claim 4, wherein said polyurethane binder is matt.

7. A method according to claim 4, wherein said two protective film-forming agents consist of 320 to 350 g of an aqueous emulsion of copolymerized acrylic esters and of 130 to 200 g of an aliphatic polyurethane in an aqueous disperse system.

8. A method according to claim 1, wherein said waterproof material is a mixture of 270 to 280 g of a polyurethane-based solution; of 10 to 12 g of a polyaziridine-based catalyst; 10 to 12 g of water; 15 to 18 g of a mixture of fatty materials.

9. A method according to claim 4, wherein said coloring mixture further comprises 13 to 15 g of a brightener and 50 to 60 g of a touch modifier.

10. A method according to claim 3, wherein said mixture of metallic-finish colors is made by cold mixing a waterproofing material and a coloring agent based on powders selected from the group consisting of a metal agent, a pearlescent agent and mixture thereof.

11. A method according to claim 1, wherein said coloring material is a metallic-finish color and said fixing material is a polyurethane-based fixing agent mixed with a touch modifier.

* * * * *